United States Patent [19]

Miller et al.

[11] Patent Number: 4,606,885

[45] Date of Patent: Aug. 19, 1986

[54] HIGH PURITY COBALT ARTICLE

[75] Inventors: Michael J. Miller; Martin B. MacInnis, both of Towanda, Pa.

[73] Assignee: GTE Products Corporation, Stamford, Conn.

[21] Appl. No.: 746,702

[22] Filed: Jun. 20, 1985

[51] Int. Cl.[4] ..... B22F 1/00

[52] U.S. Cl. ..... 419/39; 75/82; 419/38; 419/58; 419/66

[58] Field of Search ..... 419/38, 58, 39, 66; 75/82

[56] References Cited

U.S. PATENT DOCUMENTS 4,063,940 12/1977 Dain et al. ..... 419/38

4,466,826 8/1984 Vartiainen ..... 75/82

*Primary Examiner*—Stephen J. Lechert, Jr.

*Attorney, Agent, or Firm*—Donald R. Castle; L. Rita Quatrini

[57] ABSTRACT

An improvement is disclosed in a process for recovery of cobalt from cobalt bearing material to obtain fine cobalt metal powder of high purity, the improvement being mechanically compacting the powder into a billet and sintering the billet in a hydrogen atmosphere at a sufficient temperature for a sufficient time to densify the billet and form a high purity cobalt article having an oxygen content of no greater than about 500 weight parts per million.

5 Claims, No Drawings

HIGH PURITY COBALT ARTICLE

BACKGROUND OF THE INVENTION

This invention relates to an improvement in a process for recovery of cobalt from cobalt bearing material by which a high purity cobalt article is produced.

Superalloy manufacturers presently use high purity cobalt metal in the production of their alloys. This cobalt metal is in the form of electrolytic broken cathodes which range in size from approximately 0.1 to about 2 inches on a side. They must be prepared by electrodeposition from a cobalt solution. The cobalt solution must be of high purity, which involves extra processing to obtain.

It would be desirable to produce from alloy scrap a pure cobalt in a form which can be used in the manufacture of superalloys. An advantage of this would be that some of this scrap material could be obtained from the superalloy manufacturers themselves, thereby making more efficient use of this strategically important metal.

SUMMARY OF THE INVENTION

In accordance with one aspect of this invention, there is provided an improvement in a process for recovery of cobalt from cobalt bearing material to obtain fine cobalt metal powder of high purity, the improvement being mechanically compacting the powder into a billet and sintering the billet in a hydrogen atmosphere at a sufficient temperature for a sufficient time to densify the billet and form a high purity cobalt article having an oxygen content of no greater than about 500 weight parts per million.

DETAILED DESCRIPTION OF THE INVENTION

For a better understanding of the present invention, together with other and further objects, advantages, and capabilities thereof, reference is made to the following disclosure and appended claims in connection with the foregoing description of some of the aspects of the invention.

The cobalt metal powder which is compacted can be any cobalt metal powder provided it is of relatively high purity.

The cobalt metal powder can be obtained by any method known in the art. The most preferred methods of obtaining the cobalt metal powder from cobalt bearing material are described in the following United States Patents which are herein incorporated by reference. U.S. Pat. No. 4,184,868 relates to a method for producing extra fine cobalt metal powder by digesting cobalt pentammine chloride in ammonium hydroxide to obtain a black preicipitate which contains cobalt and which is thereafter reduced to the metal powder. U.S. Pat. Nos. 4,214,894, 4,233,063, and 4,278,463 relate to improvements in 4,184,868 in which the ammonia solutions are processed to recover any cobalt therein. U.S. Pat. Nos. 4,395,278 and 4,469,505 relate to improvements in 4,184,868 in which fine cobalt metal powder is produced having reduced tailings.

U.S. Pat. No. 4,214,895 relates to a process for producing cobalt metal powder which involves treating an aqueous solution of a soluble cobaltic ammine halide with a sufficient amount of a soluble metallic hydroxide to form a cobalt containing precipitate which is thereafter reduced to metallic cobalt.

U.S. Pat. No. 4,218,240 relates to a method for producing cobalt metal powder by forming a solution of a cobalt hexammine compound and treating the solution with a metallic hydroxide to form a precipitate which is reduced to cobalt metal powder. U.S. Pat. Nos. 4,348,224 and 4,381,937 relate to improvements in the process described in 4,218,240 which involve removal of copper and silver from the cobalt. U.S. Pat. No. 4,452,633 relates to an improvement in the processes described in 4,218,240 and 4,348,224 in which the silver is recovered.

U.S. Pat. No. 4,329,169 relates to a process for producing fine particle size cobalt metal powder absent tailings by heating an aqueous solution of soluble cobalt ammine halide to decompose the halide and form a cobalt containing precipitate which is reduced to the cobalt metal powder.

U.S. Pat. No. 4,409,019 relates to a process for producing fine cobalt metal powder from pieces of relatively pure cobalt by dissolving the cobalt pieces in an aqueous solution of hydrogen iodide and iodine and forming a cobalt containing solid which is subsequently reduced to a fine cobalt metal powder.

The cobalt metal powder is then mechanically compacted into a billet. Typically, the powder is charged to a die in a press and pressed at from about 20 to about 40 tons per square inch of pressure. The dimensions and geometry of the press utilized for compaction can be altered to a form and size which provides convenient handling characteristics of the finished article.

The resulting billet is then sintered in a hydrogen atmosphere at a sufficient temperature for a sufficient time to densify the billet and form the high purity cobalt article. Sintering temperatures are at least about 900° C. and generally from about 900° C. to about 1400° C. Sintering times are generally from about 1 hour to about 4 hours.

As a result of the sintering process, the oxygen content and very likely the content of other impurities which are vaporized at the sintering temperatures such as sulfur, carbon, hydrogen, and nitrogen are reduced.

The resulting sintered billet or cobalt article has a purity of at least about 99.9%. The oxygen content of the article is generally no greater than about 500 and most typically no greater than about 260 weight parts per million of the article, as opposed to an oxygen content of the starting powder of from about 4000 to about 5000 weight parts per million.

By virtue of the purity of the article and its availability in essentially any usable form, it can be used in essentialy any application requiring high purity cobalt.

To more fully illustrate this invention, the following non-limiting examples are presented. All parts, portions, and percentages are on a weight basis.

EXAMPLE 1

Cobalt containing alloy scrap material is processed according to known methods to obtain cobalt metal powder. The powder is charged to a die of about $\frac{5}{8}$" in diameter and pressed at about 32.5 tsi. The resulting compacts are sintered at about 1000° C. for about 2 hours in a hydrogen atmosphere. The resulting compacts are at least about 99.9% pure.

EXAMPLE 2

The procedure in Example 1 is repeated with a sintering temperature of about 1200° C. The resulting compacts are at least about 99.9% pure. The analyses of the compacts of Examples 1 and 2 are given in the Table along with an analysis of the starting powder. It can be seen that especially the oxygen content is significantly reduced by formation of the sintered compacts.

TABLE

| | Analyses in ppm | | |
|---|---|---|---|
| | Co Metal | SINTERED COMPACTS | |
| | Powder | Example 1 | Example 2 |
| Ni | 50 | 45 | 46 |
| Fe | 19 | 20 | 36 |
| Mn | <7 | <7 | <7 |
| Cu | <3 | 4.4 | 19 |
| Pb | 2 | <2 | 3 |
| Zn | 13 | <5 | <5 |
| Si | 54 | 44 | 49 |
| Al | <50 | <50 | <50 |
| S | 10 | <5 | <5 |
| C | 110 | 14 | 22 |
| $O_2$ | 4000–5000 | 260 | 260 |
| Bi | <0.5 | <0.5 | <0.5 |
| As | <5 | <5 | <5 |
| $N_2$ | | 2 | <1 |
| Sb | <1 | <1 | <1 |
| P | 35 | 25 | 32 |
| Sn | <5 | <5 | <5 |
| Se | <1 | <1 | <1 |
| Ag | 11 | 9 | 9 |
| Cd | 7 | <5 | <5 |
| Te | <0.5 | <0.5 | <0.5 |
| Tl | <0.5 | <0.5 | <0.5 |

TABLE-continued

| | Analyses in ppm | | |
|---|---|---|---|
| | Co Metal | SINTERED COMPACTS | |
| | Powder | Example 1 | Example 2 |
| Hg | <5 | <5 | <5 |

While there has been shown and described what are at present considered the preferred embodiments of the invention, it will be obvious to those skilled in the art that various changes and modifications may be made therein without departing from the scope of the invention as defined by the appended claims.

What is claimed is:

1. In a process for recovery of cobalt from cobalt bearing material to obtain fine cobalt metal powder of high purity, the improvement comprising mechanically compacting said powder into a billet and sintering said billet in a hydrogen atmosphere at a sufficient temperature for a sufficient time to densify said billet and form a high purity cobalt article having an oxygen content of no greater than about 500 weight parts per million.

2. An improvement of claim 1 wherein said powder is compacted by pressing said powder at a pressure of from about 20 tons per square inch to about 40 tons per square inch.

3. An improvement of claim 1 wherein said billet is sintered at from about 900° C. to about 1400° C. for from about 1 hour to about 4 hours.

4. An improvement of claim 1 wherein the purity of the article is at least about 99.9%.

5. An improvement of claim 1 wherein the oxygen content of said article is no greater than about 260 weight parts per million.

* * * * *